US006559710B2

(12) United States Patent
Matsuoka

(10) Patent No.: US 6,559,710 B2
(45) Date of Patent: May 6, 2003

(54) RAISED VOLTAGE GENERATION CIRCUIT

(75) Inventor: Nobuaki Matsuoka, Tenri (JP)

(73) Assignee: Sharp Kabushiki Kaisha (JP)

( * ) Notice: Subject to any disclaimer, the term of this patent is extended or adjusted under 35 U.S.C. 154(b) by 0 days.

(21) Appl. No.: 10/087,720

(22) Filed: Feb. 28, 2002

(65) Prior Publication Data

US 2002/0125936 A1 Sep. 12, 2002

(30) Foreign Application Priority Data

Mar. 1, 2001 (JP) ..... 2001-056114

(51) Int. Cl.[7] ..... G05F 1/575

(52) U.S. Cl. ..... 327/537; 327/541; 365/189.09; 363/60

(58) Field of Search ..... 327/535–538, 327/540, 541, 543; 365/189.09, 226; 363/59, 60; 307/110

(56) References Cited

U.S. PATENT DOCUMENTS 5,339,272 A * 8/1994 Tedrow et al. ..... 365/189.09
5,946,258 A * 8/1999 Evertt et al. ..... 365/226
5,973,550 A * 10/1999 Bowers et al. ..... 327/541
6,297,687 B1 * 10/2001 Sugimura ..... 327/536

FOREIGN PATENT DOCUMENTS

JP 07-072944 3/1995 ..... G05F/3/24

* cited by examiner

*Primary Examiner*—Timothy P. Callahan
*Assistant Examiner*—Terry L. Englund
(74) *Attorney, Agent, or Firm*—Morrison & Foerster LLP

(57) ABSTRACT

A raised voltage generation circuit includes a charge pump circuit for outputting a first voltage, a voltage dividing circuit for receiving the first voltage and outputting second and third voltages, a first transistor for receiving the second voltage at a gate thereof, a second transistor for receiving the third voltage at a gate thereof, and a control circuit for controlling whether or not to operate the charge pump circuit. Currents of the same value flow through the first and second transistors when the first voltage is equal to a predetermined value, currents of different values flow through the first and second transistors when the first voltage is not equal to the predetermined value, and the control circuit controls whether or not to operate the charge pump circuit based on the currents that flow through the first and second transistors.

5 Claims, 5 Drawing Sheets

Prior Art

RAISED VOLTAGE GENERATION CIRCUIT

CROSS-REFERENCE TO RELATED APPLICATIONS

This application claims priority to Japanese Patent Application Number 2001-056114 filed Mar. 1, 2001, the content of which is incorporated herein by reference in its entirety.

1. Field of the Invention

The present invention relates to a raised voltage generation circuit used for a semiconductor integrated circuit device. More specifically, the present invention relates to a raised voltage generation circuit used for a nonvolatile semiconductor memory device, and the like, which requires a voltage equal to or higher than a power source voltage, i.e., a raised voltage.

2. Description of the Related Art

In recent years, a power source voltage for a nonvolatile semiconductor memory device (a flash EEPROM) has been decreasing. In general, in order to decrease the power source voltage while maintaining fast access, a selected level of a voltage applied to a word line, which is coupled to a gate of a flash EEPROM cell, is raised to the level of the power source voltage or higher.

In the conventional art, a circuit for generating a raised voltage is well known. FIG. 2 shows a typical raised voltage generation circuit 200. Sources of p-type MOSFETs T8 and T9 are connected to power source voltage Vcc. A gate of the p-type MOSFET T8 and a gate and drain of the p-type MOSFET T9 are connected to a node N7. Thus, the p-type MOSFETs T8 and T9 form a current mirror circuit. The same amount of current flows through each of the p-type MOSFETs T8 and T9. The node N7 is also connected to a drain of an n-type MOSFET T10. Reference voltage Vref is output from a reference voltage generation circuit V1 to a gate of the n-type MOSFET T10. On the other hand, voltage Vdiv is applied to a gate of an n-type MOSFET T11, which is paired with the n-type MOSFET T10. Voltage Vdiv is obtained by dividing raised voltage Vout, which is output from a charge pump circuit P2 to an output node N9, using resistances R3 and R4. A drain of a source-grounded n-type MOSFET T12 is connected to sources of the n-type MOSFETs T10 and T11. The n-type MOSFET T12 performs power down control and source potential control of the n-type MOSFETs T10 and T11. A capacitor C2, which is connected to an output of the charge pump circuit P2, smoothes a raised voltage before it is output from the raised voltage generation circuit 200.

In the circuit described above, when the values of reference voltage Vref and divided voltage Vdiv are the same, the amount of current flowing through each of the n-type MOSFETs T10 and T11 are also the same. Thus, a state of equilibrium is achieved between the n-type MOSFETs T10 and T11. However, for example, when raised voltage Vout, which is output from the charge pump circuit P2 through an output node N9, is decreased, and divided voltage Vdiv becomes lower than reference voltage Vref, an amount of current flowing through the n-type MOSFET T11 is decreased and the potential at a node N8, which connects a drain of the p-type MOSFET T8 and a drain of the n-type MOSFET T11 is increased. As a result, a charge pump circuit enable signal ENB, which is output from an inverter I4 to which the potential at the node N8 is input, goes to a low level, so that the operation of the charge pump circuit P2 is activated. Alternatively, when raised voltage Vout at the node N9 rises, and voltage Vdiv becomes higher than voltage Vref, an amount of current flowing through the n-type MOSFET T11 is increased, and the potential at the node N8 is decreased. As a result, the charge pump circuit enable signal ENB goes to a high level, and the operation of the charge pump circuit P2 is stopped. In other words, the potential of the node N8 is determined by a ratio of the currents flowing through the n-type MOSFETs T10 and T11. The inverter I4 performs operation control of the charge pump circuit P2 in accordance with changes in potential at the node N9 from the state of equilibrium so as to maintain output of the raised voltage Vout to be at an approximately constant potential.

There are various types of circuit arrangements for the reference voltage generation circuit V1 for outputting reference voltage Vref. As an example of the reference voltage generation circuit V1, FIG. 3 shows a reference voltage generation circuit including a pair of flash EEPROM cells (for example, floating-gate-type MOS transistors), which is disclosed in Japanese Laid-Open Publication No. 7-72944. Sources of p-type MOSFETs T13 and T14 are connected to output voltage Vout of a charge pump circuit P3. A gate and drain of the p-type MOSFET T13 and a gate of the p-type MOSFET T14 are connected to a node N12. In this structure, the p-type MOSFETs T13 and T14 together function as a current mirror circuit. The same amount of the current flows through each of the p-type MOSFETs T13 and T14. Drains of the p-type MOSFETs T13 and T14 are respectively connected to drains of n-type MOSFETs T15 and T16. Sources of the n-type MOSFETs T15 and T16 are respectively connected to drains of flash EEPROM cells F3 and F4 which have different amounts of charge stored in their floating gates. The n-type MOSFETs T15 and T16 decrease the voltage at the drains of the flash EEPROM cells F3 and F4 to 1 volt or lower. In this example, the voltage applied to each of the gates of the n-type MOSFETs T15 and T16 is 2Vtn, which is twice as large as a threshold voltage of the n-type MOSFETs T15 and T16. Sources of the flash EEPROM cells F3 and F4 are both connected to the ground potential. Reference voltage Vref, which is output from the reference voltage generation circuit V1, and a divided voltage at node N10, which is obtained by dividing reference voltage Vref using resistances R5 and R6, are respectively applied to gates of the flash EEPROM cells F3 and F4. The amount of charge stored in each of the flash EEPROM cells F3 and F4 is adjusted such that a state of equilibrium is achieved, i.e., the same amount of the current flows through each of the flash EEPROM cells F3 and F4, when output voltage Vref is equal to a predetermined potential.

In such a circuit arrangement, when reference voltage Vref is low, the amount of current which flows through the flash EEPROM cell F4 significantly decreases compared to the amount of current which flows through the flash EEPROM cell F3, and the voltage at the node N11 rises. As a result, the voltage at the gate of the n-type MOSFET T17, whose threshold voltage is lower than that of a typical n-type MOSFET, is increased, and output voltage Vout of the charge pump circuit P3 is supplied to reference voltage Vref. Alternatively, when reference voltage Vref is high, the amount of current flowing through the flash EEPROM cell F4 significantly increases in comparison with the amount of current flowing through the flash EEPROM cell F3, and the potential at the node N11 decreases. Thus, supply of Vout to Vref is interrupted by the n-type MOSFET T17. With such an operation, it is possible to maintain reference voltage Vref to be an approximately constant potential. As described above, the reference voltage generation circuit V1 does not operate with a low voltage, and requires a voltage raised by the charge pump circuit P3 as a power source.

There are various types of circuit arrangements for the charge pump circuit P3. FIG. 4 shows a typical charge pump circuit. N-type MOSFETs T18, T19, and T20 are connected in series. Gates of the n-type MOSFETs T18, T19, and T20 are respectively connected to drains thereof, thereby acting as MOS diodes for preventing a backflow from source to drain. A P-type MOSFET T21 receives the charge pump circuit enable signal ENB and supplies power source voltage Vcc to the n-type MOSFET T18. A capacitor C3 is connected between a node N15 and a node N17. The node N15 is connected to the gate of the n-type MOSFET T19. The node N17 is an output node of an inverter I5 which is driven in response to receiving a clock signal CLK1. On the other hand, a capacitor C4 is connected between a node N18 and a node N16. The node N18 is an output node of an inverter I6 which is driven in response to receiving a clock signal CLK2. The node N16 is connected to the gate of the n-type MOSFET T20.

In such a circuit arrangement, initially, a voltage at the node N15 can be represented as a value obtained by subtracting threshold voltage Vtn of the n-type MOSFET T18 from power source voltage Vcc, i.e., Vcc−Vtn. As the clock signal CLK1 changes from Vcc to 0V, a voltage at the node N17 is raised from 0V to Vcc, thereby raising the voltage at the node N15 to 2Vcc−Vtn. A voltage at the node N16 can be represented as a value obtained by subtracting threshold voltage Vtn of the n-type MOSFET T19 from the voltage at node N15, i.e., 2Vcc−2Vtn. By changing the clock signal CLK2 from Vcc to 0V, the voltage at the node N18 is raised from 0V to Vcc, thereby raising the voltage at the node N16 to 3Vcc−2Vtn. The voltage raising operation is performed as described above. The charge pump circuit P3 is always in operation during the operation of the reference voltage generation circuit V1. Furthermore, output voltage Vout varies in accordance with a variation in power source voltage Vcc. Further still, it is possible to maintain the output voltage of the charge pump circuit to be a constant potential, although an additional reference voltage generation circuit is required.

As described above, the reference voltage generation circuit V1 using a flash EEPROM cell requires the charge pump circuit P3. Furthermore, the raised voltage generation circuit 200 additionally requires the charge pump circuit P2 in order to obtain a raised voltage which is used for raising a word line potential. In other words, the raised voltage generation circuit 200 requires two charge pump circuits. In the raised voltage generation circuit 200, a reference voltage generation circuit is essential for maintaining output voltage Vout to be a constant potential.

SUMMARY OF THE INVENTION

According to one aspect of the present invention, there is provided a raised voltage generation circuit, including a charge pump circuit for outputting a first voltage, a voltage dividing circuit for receiving the first voltage and outputting second and third voltages, a first transistor for receiving the second voltage at a gate thereof, a second transistor for receiving the third voltage at a gate thereof, and a control circuit for controlling whether or not to operate the charge pump circuit, wherein currents of the same value flow through in the first and second transistors when the first voltage is equal to a predetermined value, currents of different values flow through the first and second transistors when the first voltage is not equal to the predetermined value, and the control circuit controls whether or not to operate the charge pump circuit based on the currents that flow through the first and second transistors.

In one embodiment of the present invention, the control circuit includes a current mirror circuit.

In one embodiment of the present invention, the first transistor, the second transistor, and the control circuit function as a current mirror-type differential amplifier.

In one embodiment of the present invention, the first voltage and the second voltage have the same value.

In one embodiment of the present invention, the first transistor and the second transistor are floating-gate-type MOS transistors, and the amount of charge stored in a floating gate of the first transistor and in a floating gate of the second transistor are different from each other.

With the above structure of the present invention, in a raised voltage generation circuit for generating a raised voltage by using a charge pump circuit, it is possible to maintain an output voltage to be a predetermined potential without using a reference voltage generation circuit which incorporates another charge pump circuit therein. In a conventional raised voltage generation circuit, it is required to provide at least two charge pump circuits, one for generating a raised voltage and the other for generating a reference voltage. In the raised voltage generation circuit according to the present invention, a raised voltage output from the charge pump circuit is used as both the output voltage and the reference voltage of the raised voltage generation circuit. Thus, a stable raised voltage can be output with only one charge pump circuit. A charge pump circuit is a critical element in determining a chip area because of its structure. Therefore, if one charge pump circuit is used for generating both the output voltage and the reference voltage of the raised voltage generation circuit, i.e., if the number of charge pump circuits is reduced, the chip area can be significantly reduced. Moreover, since a reference voltage generation circuit is not used, a reduction in current consumption, a reduction in chip area, and a reduction in the number of control circuits can be achieved.

Thus, the invention described herein makes possible the advantages of providing a raised voltage generation circuit using a charge pump circuit, in which a raised voltage from the charge pump circuit can be controlled so as to be kept constant without using a reference voltage generation circuit.

These and other advantages of the present invention will become apparent to those skilled in the art upon reading and understanding the following detailed description with reference to the accompanying figures.

DESCRIPTION OF THE PREFERRED EMBODIMENTS

Figure 1:
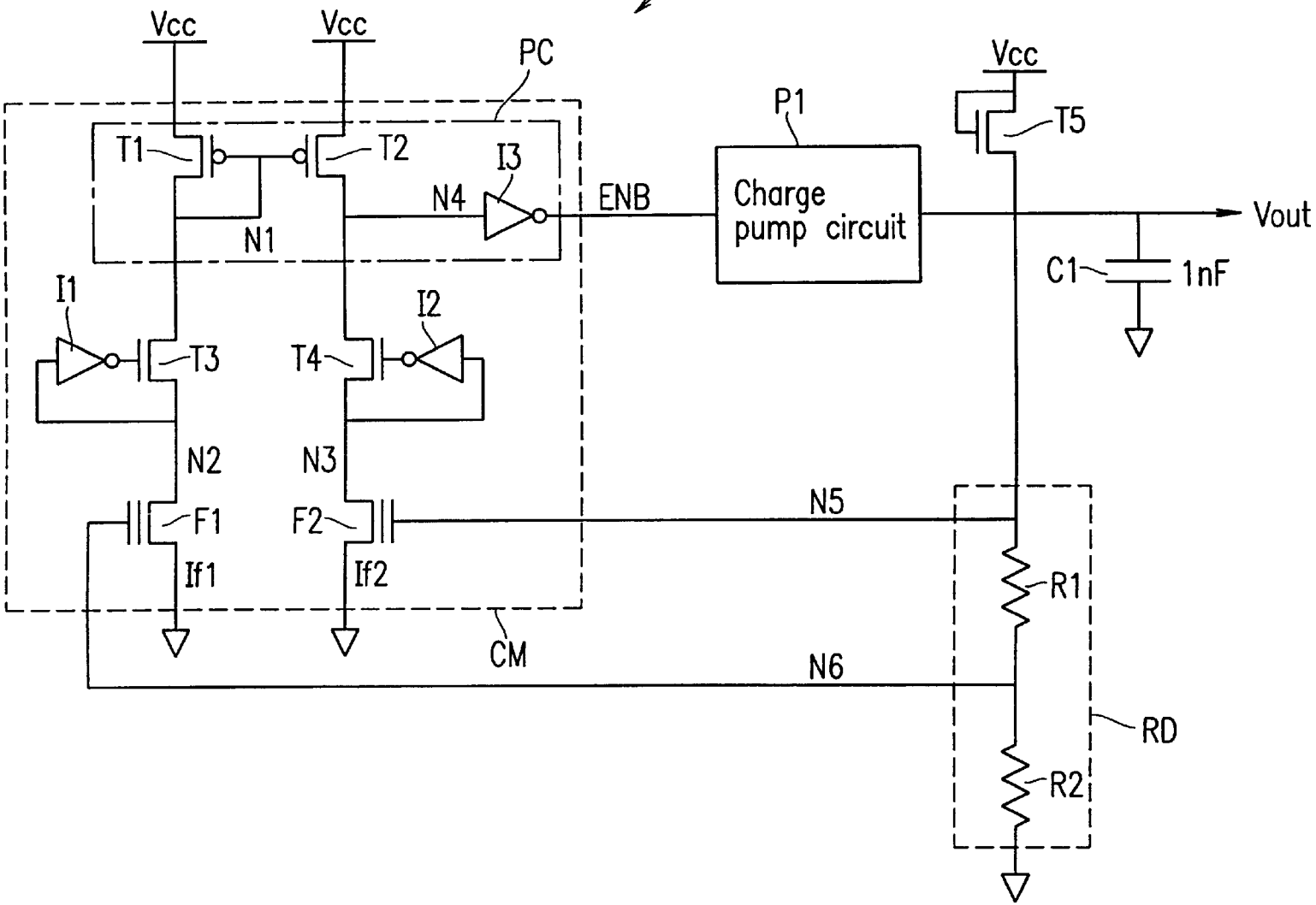
FIG. 1 shows a raised voltage generation circuit according to an embodiment of the present invention.
Figure 2:
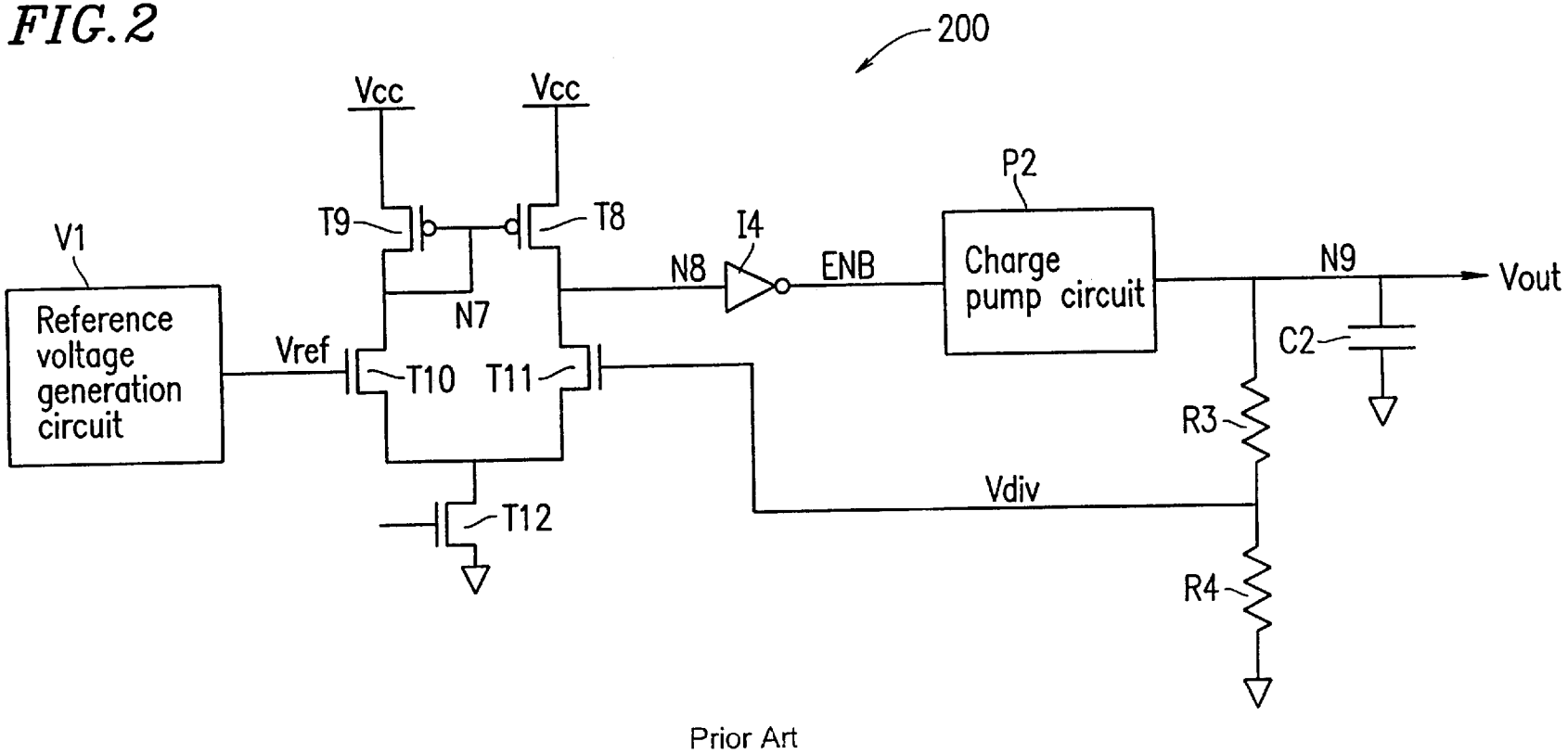
FIG. 2 Prior Art
FIG. 2 shows a conventional raised voltage generation circuit.
Figure 3:
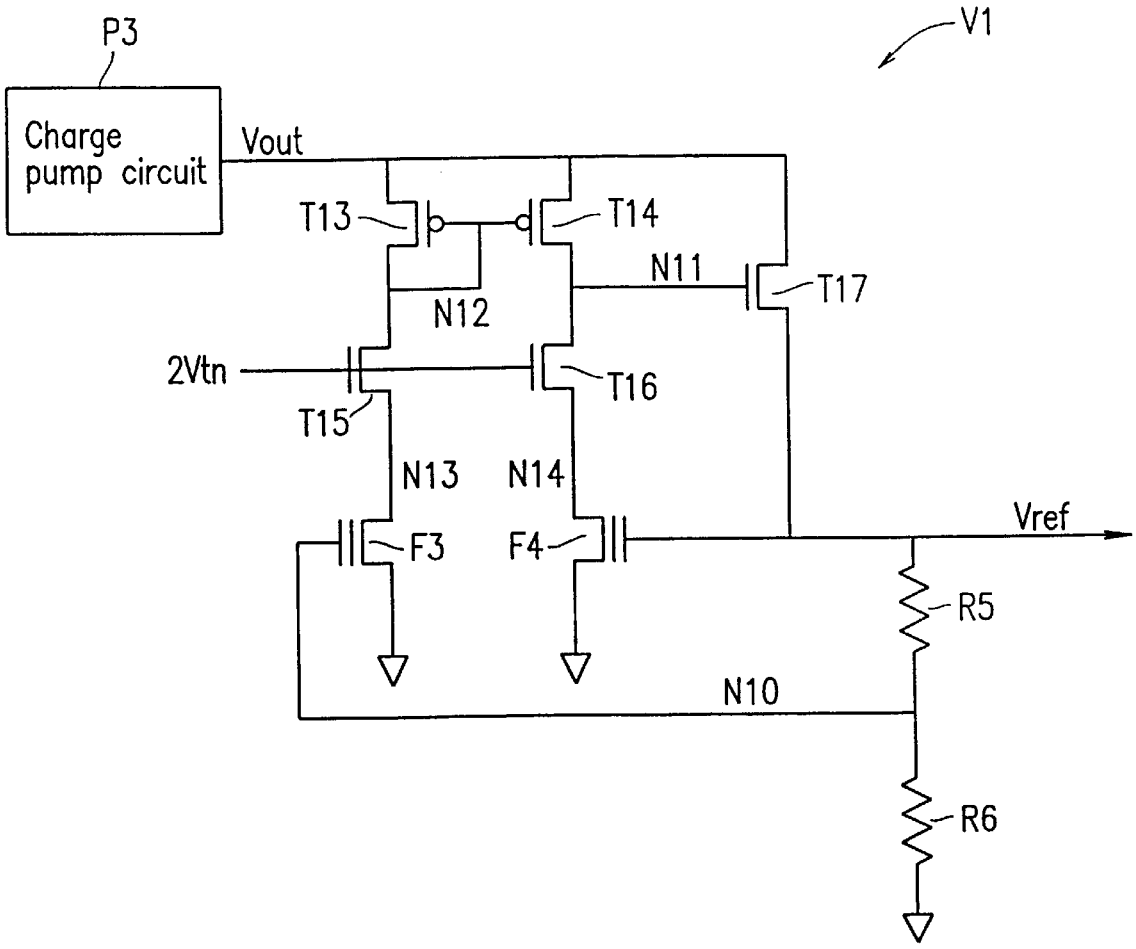
FIG. 3 shows a reference voltage generation circuit used in the conventional raised voltage generation circuit.

FIG. 1 shows a raised voltage generation circuit 100 according to one embodiment of the present invention. The raised voltage generation circuit 100 raises a power source voltage and outputs the raised voltage.

The raised voltage generation circuit 100 includes a charge pump circuit P1, a control circuit PC, and a pair of flash EEPROM cells (for example, floating-gate-type MOS transistors) F1 and F2, which are approximately identical in structure. The control circuit PC controls whether or not to activate the charge pump circuit P1. The flash EEPROM cells F1 and F2 store information according to the amount of stored charges (for example, electrons) injected into the floating gates thereof. The flash EEPROM cells F1 and F2 are programmed so as to have different charges in the floating gates from each other. The flash EEPROM cells F1 and F2 and the control circuit PC together function as a current mirror-type differential amplifier. When a large number of electrons are injected into the floating gates, inversion layers are less likely to be formed in channel regions of the transistors, and as a result, a threshold voltage of a memory cell is increased. In this manner, the threshold voltage of the flash EEPROM cell F2 is set to be a high voltage. Alternatively, when electrons are released from the floating gates, or when a small number of electrons are injected into the floating gates, inversion layers are more likely to be formed in the channel regions, and as a result, the threshold voltage of the memory cell is decreased. In this manner, the threshold voltage of the flash EEPROM cell F1 is set to be a low voltage.

Node N1 is connected to a gate and a drain of a P-type MOFET T1 and a gate of the p-type MOSFET T2. Sources of the p-type MOSFETs T1 and T2 are connected to power source voltage Vcc. Power source voltage Vcc may be supplied externally, for example, and is to be raised by the raised voltage generation circuit 100. Power source voltage Vcc supplies currents to the flash EEPROM cells F1 and F2. The same amount of current flows through each of the p-type MOSFETs T1 and T2, such that the control circuit PC includes a current mirror circuit formed of the p-type MOSFETs T1 and T2. N-type MOSFETs T3 and T4 are provided for controlling the voltages at drains of the flash EEPROM cells F1 and F2 (i.e., voltages at nodes N2 and N3) so as to be 1V or less. For example, when the voltage at the node N2 is high, an output of inverter I1 goes to a low level, and a gate of the n-type MOSFET T3 goes to the low level. Thus, a rise in the voltage at the node N2 is prevented. Alternatively, when the voltage at the node N2 is low, the output of the inverter I1 goes to a high level, and a gate of the n-type MOSFET T3 goes to a high level. Thus, the voltage at the node N2 is further raised. For the node N3, an inverter I2 behaves in a similar fashion to the inverter I1, so that the voltage at the node N3 is maintained to be 1V or less. Sources of the flash EEPROM cells F1 and F2 are connected to a ground potential.

Figure 4:
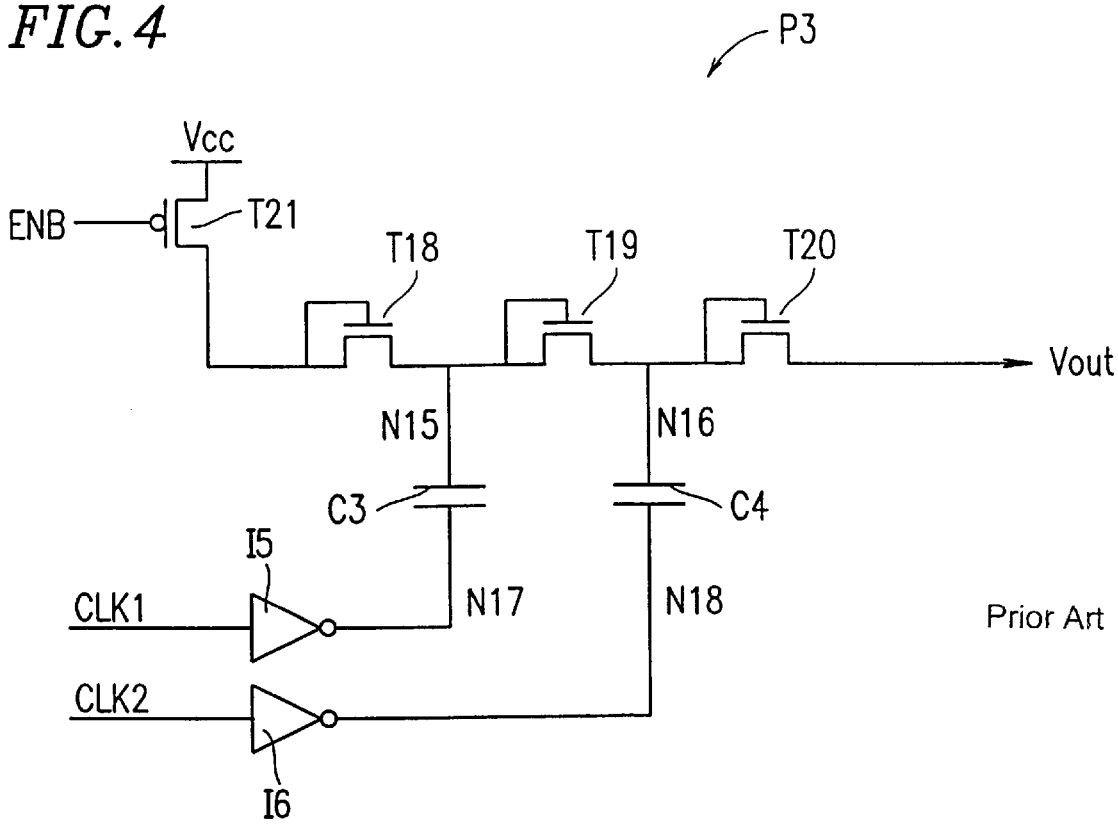
FIG. 4 shows a charge pump circuit.

An n-type MOSFET T5 is provided to assist the function of the charge pump circuit P1. In this example, a transistor which has a threshold lower than that of a typical n-type MOSFET is used as the n-type MOSFET T5. The n-type MOSFET T5 assists the charge pump circuit P1 especially in maintaining output voltage Vout whilst the charge pump circuit P1 is active. A capacitor C1 (1nF) connected to an output of the charge pump circuit P1 smoothes an output raised voltage of the raised voltage generation circuit. The charge pump circuit P1 may have the same structure as that of the charge pump circuit P3 shown in FIG. 4. As a matter of course, a charge pump circuit having any other structure may be used.

On the output side of the charge pump circuit P1, a resistive voltage dividing circuit RD including resistances R1 and R2 is connected. A voltage at a node N6 is obtained by dividing the voltage at a node N5 (i.e., output voltage Vout) using the pair of resistances R1 and R2. In this embodiment, resistance values of the resistances R1 and R2 are set so as to be equal to each other. In other words, the voltage at the node N6 is a ½ of the voltage at the node N5. The node N6 is connected to a gate of the flash EEPROM cell F1. The node N5 is connected to a gate of the flash EEPROM cell F2.

When the voltage at the node N5 is decreased, the gate voltage of the flash EEPROM cell F2 is decreased. As a result, current If2 which flows through the flash EEPROM cell F2 is decreased. On the other hand, the gate voltage of the flash EEPROM cell F1 is also decreased. However, since the potential at the node N6 is ½ that of the potential at the node N5 because of the resistances R1 and R2, the amount of changes in current If1 is smaller than that in current If2 that flows in the flash EEPROM cell F2. Therefore, a state of equilibrium where If1=If2 changes into a state where If1>If2. As a result, the voltage at a node N4, which is a junction point of a drain of the p-type MOSFET T2 and a drain of the n-type MOSFET T4, is increased. A charge pump circuit enable signal ENB, which is an output signal of an inverter I3, goes to a low level, so that the charge pump circuit P1 is activated. Accordingly, the voltage at the node N5 is increased.

When the voltage at the node N5 is increased by the charge pump circuit P1, the gate voltage of the flash EEPROM cell F2 rises, and current If2 flowing through the flash EEPROM cell F2 is increased. The gate voltage of the flash EEPROM cell F1 is also increased. As a result, current If1 flowing through the flash EEPROM cell F1 is also increased. However, as described above, the amount of increase in current If1 is smaller than that in current If2 that flows in the flash EEPROM cell F2. Therefore, If1 becomes smaller than If2 (If1<If2), and the potential at the node N4 is decreased. As a result, the charge pump circuit enable signal ENB, which is an output signal of the inverter I3, goes to a high level, and the charge pump circuit P1 is placed into a non-operation (i.e., stand-by) state. When the charge pump circuit P1 is in the non-operation state, a rise in the voltage at the node N5 is stopped.

Figure 5:
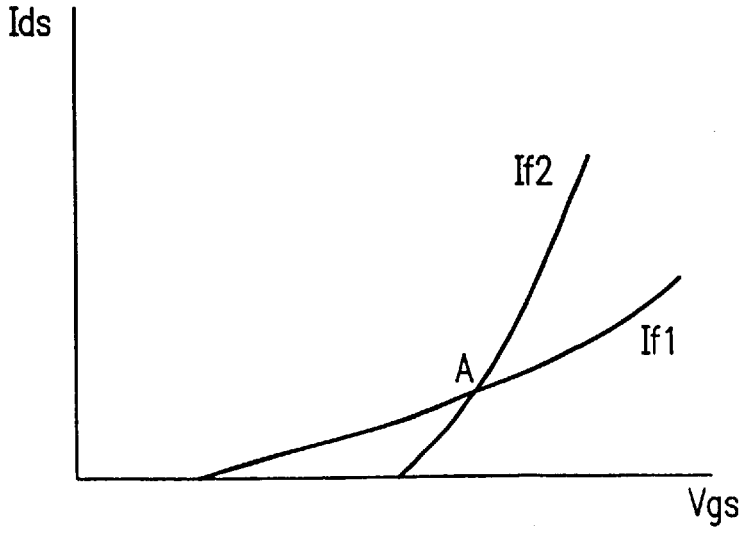
FIG. 5 shows a relationship between drain-source current Ids and gate voltage Vgs of flash EEPROM cells used in a raised voltage generation circuit according to an embodiment of the present invention.

FIG. 5 shows a relationship between source-drain current Ids and gate voltage Vgs in each of the flash EEPROM cells F1 and F2. Intersection point A of curves If1 and If2 indicates the point where the currents If1 and If2 are equal. A signal is obtained by amplifying variations in the currents and voltage from those obtained at intersection point A is used as an enable signal ENB, based on whether the charge pump circuit P1 is turned on or off, to control the operation of the charge pump circuit P1.

By repeating the above-described cycle, the charge pump circuit P1 outputs an approximately constant raised voltage to the node N5. In the case where the flash EEPROM cells F1 and F2, which are approximately identical in structure, are employed, the same amount of current flows through each of the flash EEPROM cells F1 and F2 when voltage Vgs between the gates and sources thereof are equal. Therefore, the voltage is controllable as follows. For example, in the case where the resistance ratio of the resistances R1 and R2 is set to be 1:1, and the threshold voltage of the flash EEPROM cell F1 is set to 2V, the raised voltage is constant at 4V when the threshold voltage of the flash EEPROM cell F2 is kept at 4V, and the raised voltage is constant at 5V when the threshold voltage of the flash EEPROM cell F2 is kept at 4.5V. Furthermore, by decreasing the threshold voltage of the flash EEPROM F1 as low as possible, the raised voltage generation circuit 100 operates in a stable manner even in a low voltage region.

Figure 6:
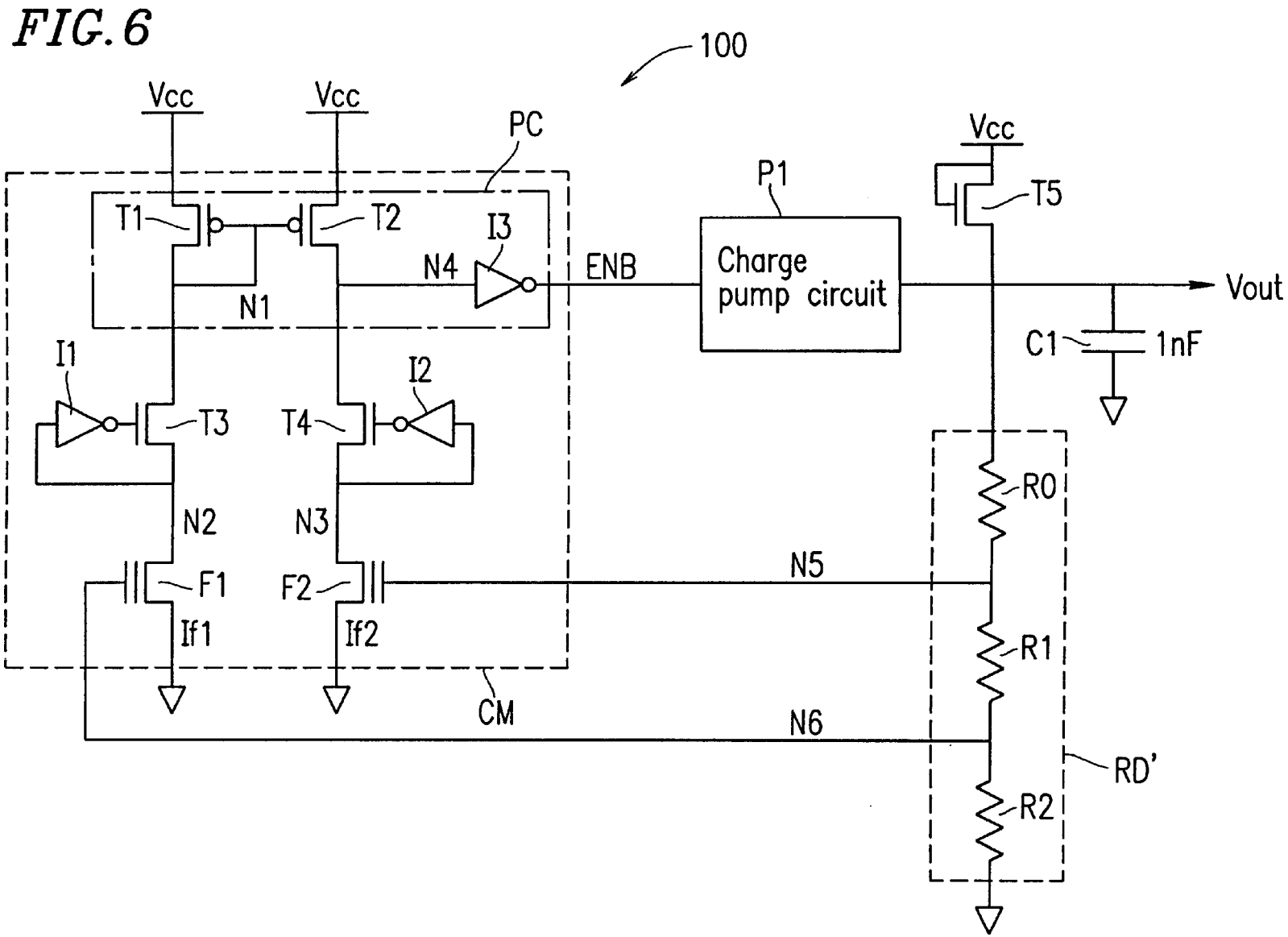
FIG. 6 shows a raised voltage generation circuit according to another embodiment of the present invention.

The structure of the resistive voltage dividing circuit RD connected on the output side of the charge pump circuit P1 is not limited to the structure shown in FIG. 1. For example, the resistive voltage dividing circuit RD may be replaced with a resistive voltage dividing circuit RD' including resistances R0, R1, and R2 shown in FIG. 6. The resistive voltage dividing circuit RD' is the only difference between the circuit of FIG. 1 and the circuit of FIG. 6. Thus, the detailed descriptions of the remaining parts are omitted.

Further, for a circuit for detecting changes in a current value in flash EEPROM cells and for outputting a charge pump circuit enable signal ENB, a circuit arrangement other than the current mirror-type differential amplifier may be employed.

In addition, in place of the flash EEPROM cells F1 and F2, other types of MOS transistors or the like, whose threshold voltages are set to be different from each other, may be used.

As described in detail above, according to the raised voltage generation circuit of the present invention, it is possible to generate a constant raised voltage without using a reference voltage generation circuit. Therefore, reduction in chip area, reduction in the number of control circuits, and reduction in current consumption can be achieved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A raised voltage generation circuit, comprising:

a charge pump circuit for outputting a first voltage;

a voltage dividing circuit for receiving the first voltage and outputting second and third voltages;

a first transistor for receiving the second voltage at a gate thereof;

a second transistor for receiving the third voltage at a gate thereof; and a control circuit for controlling whether or not to operate the charge pump circuit, wherein currents of the same value flow through the first and second transistors when the first voltage is equal to a predetermined value, currents of different values flow through the first and second transistors when the first voltage is not equal to the predetermined value, and the control circuit controls whether or not to operate the charge pump circuit based on the currents that flow through the first and second transistors.

2. A raised voltage generation circuit according to claim 1, wherein the control circuit includes a current mirror circuit.

3. A raised voltage generation circuit according to claim 2, wherein the first transistor, the second transistor, and the control circuit function as a current mirror-type differential amplifier.

4. A raised voltage generation circuit according to claim 1, wherein the first voltage and the second voltage have the same value.

5. A raised voltage generation circuit according to claim 1, wherein the first transistor and the second transistor are floating-gate-type MOS transistors, and the amount of charge stored in a floating gate of the first transistor and in a floating gate of the second transistor are different from each other.

* * * * *